United States Patent [19]

Masters

[11] 4,207,647

[45] Jun. 17, 1980

[54] MOBILE SEWER CLEANING AND VACUUM UNIT

[75] Inventor: Philip C. Masters, Ashland, Ohio

[73] Assignee: McNeil Corporation, Akron, Ohio

[21] Appl. No.: 973,606

[22] Filed: Dec. 27, 1978

Related U.S. Application Data

[63] Continuation-in-part of Ser. No. 807,225, Jun. 16, 1977, abandoned.

[51] Int. Cl.[2] ..... B08B 3/02

[52] U.S. Cl. ..... 15/302; 15/315; 15/340; 15/352; 15/353; 15/414; 15/420; 134/168 C

[58] Field of Search ..... 15/302, 304, 320, 321, 15/315, 346, 340, 414, 420, 353, 352; 134/168 C

[56] References Cited

U.S. PATENT DOCUMENTS

| | | | |
|---|---|---|---|
| 1,140,992 | 5/1915 | Martin | 15/414 X |
| 2,913,744 | 11/1959 | Gregersen | 15/340 X |
| 3,011,206 | 12/1961 | Breither | 15/320 |
| 3,052,908 | 9/1962 | Daneman | 15/340 |
| 3,172,143 | 9/1965 | Yucis et al. | 15/346 X |
| 3,444,581 | 5/1969 | Daneman | 15/314 |
| 3,600,225 | 8/1971 | Parmelee | 134/168 C X |
| 3,613,915 | 10/1971 | Vita | 15/340 X |
| 3,658,589 | 4/1972 | Shaddock | 134/168 C X |
| 3,847,293 | 11/1974 | Boon | 15/340 X |
| 3,902,219 | 9/1975 | Jones | 15/340 X |
| 3,955,236 | 5/1976 | Mekelburg | 15/340 X |
| 4,134,174 | 1/1979 | Flynn et al. | 15/302 |

*Primary Examiner*—Christopher K. Moore
*Attorney, Agent, or Firm*—Hamilton, Renner & Kenner

[57] ABSTRACT

A mobile apparatus for cleaning sewers, catch basins and the like includes a debris collection chamber mounted on the rear of a vehicular chassis. A vacuum conduit communicates with the chamber and is adapted to be lowered into the sewer. A vacuum fan also communicates with the chamber and draws air through the conduit and chamber thereby picking up debris from the sewer. As the debris enters the chamber, the configuration thereof creates a rapid decrease in the air flow velocity and otherwise interrupts the flow so that material entrained in the air is deposited in the chamber. The configuration of the chamber also permits facile discharge of the debris out of the bottom of the chamber in that one end wall of the chamber is swingable to open the bottom thereof. This same end wall also carries a hose reel for use in flushing the sewer. Because the debris which is picked up may well include water, means are provided to drain the water from the chamber.

19 Claims, 6 Drawing Figures

MOBILE SEWER CLEANING AND VACUUM UNIT

RELATED APPLICATION

This application is a continuation-in-part of my prior, co-pending application, Ser. No. 807,225 filed June 16, 1977, and now abandoned.

BACKGROUND OF THE INVENTION

This invention relates to a mobile combined sewer cleaning and vacuum machine. More particularly, this invention relates to a mobile machine which is capable of flushing sewers, catch basins or the like and then vacuuming the debris flushed from the sewer.

Both mobile sewer cleaning machines which carry hoses to flush sewers and mobile vacuum machines which draw debris into a collection box are known in the art. When used to clean a sewer, catch basin or the like, usually the sewer cleaning machine is first used to flush the sewer and then the vacuum machine, as a follow-up unit, arrives to dispose of the debris flushed from the sewer by the sewer cleaning machine. This practice results in a vast duplication of machinery and manpower and is thus economically unsatisfactory.

Recently, attempts have been made to combine the two machines in one vehicular unit. The result has been a monstrous unit in that a very large and heavy vehicle is required to carry the large collection box needed to reduce the vacuum and separate the debris from the air, and in that the separately mounted hose reel and vacuum collection conduit have both usually been awkwardly and inefficiently located at the front of the vehicle over the cab.

Both the combined unit and the separate units are fraught with additional problems. When the large debris collection box with vertical walls is used it is often difficult to provide total separation of the debris from the air flow, particularly in the case of light debris such as dry leaves or the like. While separation screens are often utilized for this purpose, they can become clogged and will need frequent cleaning. In one device a centrifugal separator is placed in the collection box and the incoming air entrained debris is directed first to the centrifugal separator with the debris, in theory, being deposited in the collection box and the air exhausted. This system not only adds significantly to the cost of the machine requiring numerous extra parts including the separator unit itself and its attendant ducts, baffles and the like, but it also wastes space in the collection box which could otherwise be used for debris.

Most often the debris is discharged from these collection boxes by tilting the box for discharge out of a rear door, much like a conventional dump truck. Such tilting requires a large hydraulic jack which is not an efficient discharge method. However, because of the configuration of the collection box, no other system for discharge has proved satisfactory.

Because the sewer or catch basin is usually flushed first with the hose and water supply carried by the unit, or because of dormant water in the sewer, the debris is often wet and a certain amount of liquid will collect in the debris collection box. Some collection boxes are provided with drains so that a hose may be connected to the drain and the water circulated back to the sewer during the vacuum operation. This amounts to an inefficient method of handling the liquid inasmuch as the same liquid may again be drawn into the collection box.

The prior art designs are further inadequate or inefficient in that they do not provide for complete maneuverability of the vacuum conduit at multiple locations around the vehicle; do not provide for conduit maneuverability once it is positioned within the sewer or catch basin; do not provide any means on the conduit to work in corners of catch basins; and do not provide any facile means of cleaning the collection box after debris has been discharged. Finally, most prior art disigns, because of their large collection boxes and adjunct items, such as centrifugal separators and the like, require hugh vehicles to power the same. In addition, power for the vacuum fan for debris collection and pump for flushing is usually derived from two separate engines or power take-offs from the engine of the vehicle—both systems adding to the cost and size of the unit.

SUMMARY OF THE INVENTION

It is thus a primary object of the present invention to provide a mobile combined sewer cleaning and vacuum unit which is compact, with separation of the debris from the air being aided by the configuration of the debris container rather than adjunct separating devices.

It is another object of the present invention to provide a unit, as above, in which the back wall of the debris collection chamber is movable to open the chamber which due to the shape thereof will automatically discharge the debris.

It is a further object of the present invention to provide a unit, as above, with means to clean the debris collection chamber and alternatively to provide moisture to dry debris being collected to aid in the separation of the debris from the air stream.

It is still another object of the present invention to provide a unit, as above, in which liquid collected in the debris collection chamber may be continually drained away or, alternatively which may be drained to a separate compartment for subsequent discharge.

It is yet another object of the present invention to provide a unit, as above, in which the vacuum conduit is mounted to the vehicle for complete maneuverability into the sewer, catch basin or the like.

It is a still further object of the present invention to provide a unit, as above, which permits complete maneuverability of the vacuum conduit once it is in the sewer, catch basin or the like.

It is another object of the present invention to provide a unit, as above, with a means to work in corners of sewers, catch basins or the like to collect debris therefrom.

It is an additional object of the present invention to provide a unit, as above, in which the pump to provide the water for sewer cleaning, the pump to drain the collection chamber, and the fan to provide the vacuum for debris collection are operated by a single power source.

These and other objects of the present invention, which will become apparent from the description to follow, are accomplished by the means hereinafter described and claimed.

In general, the mobile unit for cleaning sewers, catch basins and the like includes a vehicular chassis or body which carries all of the other members including a debris collection chamber. The chamber has a top wall, two generally parallel side walls, and two end walls converging from the top wall. A vacuum conduit communicates with the chamber and is adapted to be lowered into the sewer. A hose reel carries a hose which is adapted to be lowered into the sewer to flush the same with water. A vacuum source, such as a fan, communicates with the chamber and draws air through the conduit and the chamber to pick up debris and water from the sewer and deposit the same in the chamber. Means are provided to drain the water from the chamber to a location remote from the mobile unit.

DESCRIPTION OF THE PREFERRED EMBODIMENTS

Figure 1:
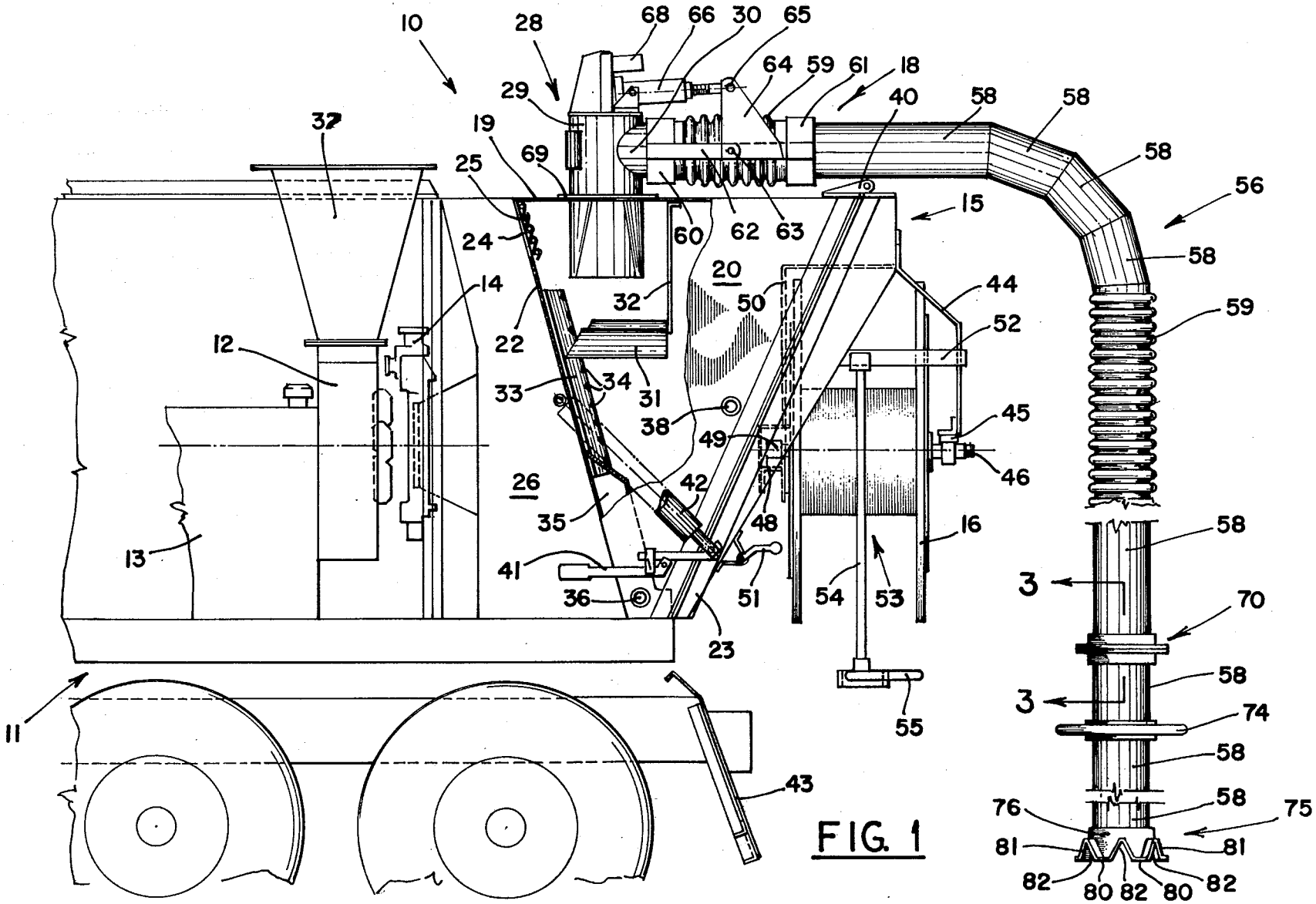
FIG. 1 is a somewhat schematic, partially broken away, elevational view of a portion of the mobile unit according to the concept of the present invention.

The combined mobile hydraulic sewer cleaning and vacuum unit according to one embodiment of the present invention is indicated generally by the numeral 10 in FIG. 1 and includes a vehicular body member or chassis 11 which is preferably a conventional truck body propelled by an internal combustion engine (not shown). Vehicular chassis 11 carries all of the components of sewer cleaning and vacuum unit 10 which, in general, includes a water supply tank (not shown) for flushing the sewer or catch basin, a pump (not shown) for propelling the water, a vacuum fan 12, an engine 13 driving the fan and pump and having a radiator 14, a debris collection chamber indicated generally by the numeral 15, a hose reel 16 for carrying a supply of hose thereon, and a vacuum conduit boom assembly indicated generally by the numeral 18.

Figure 2:
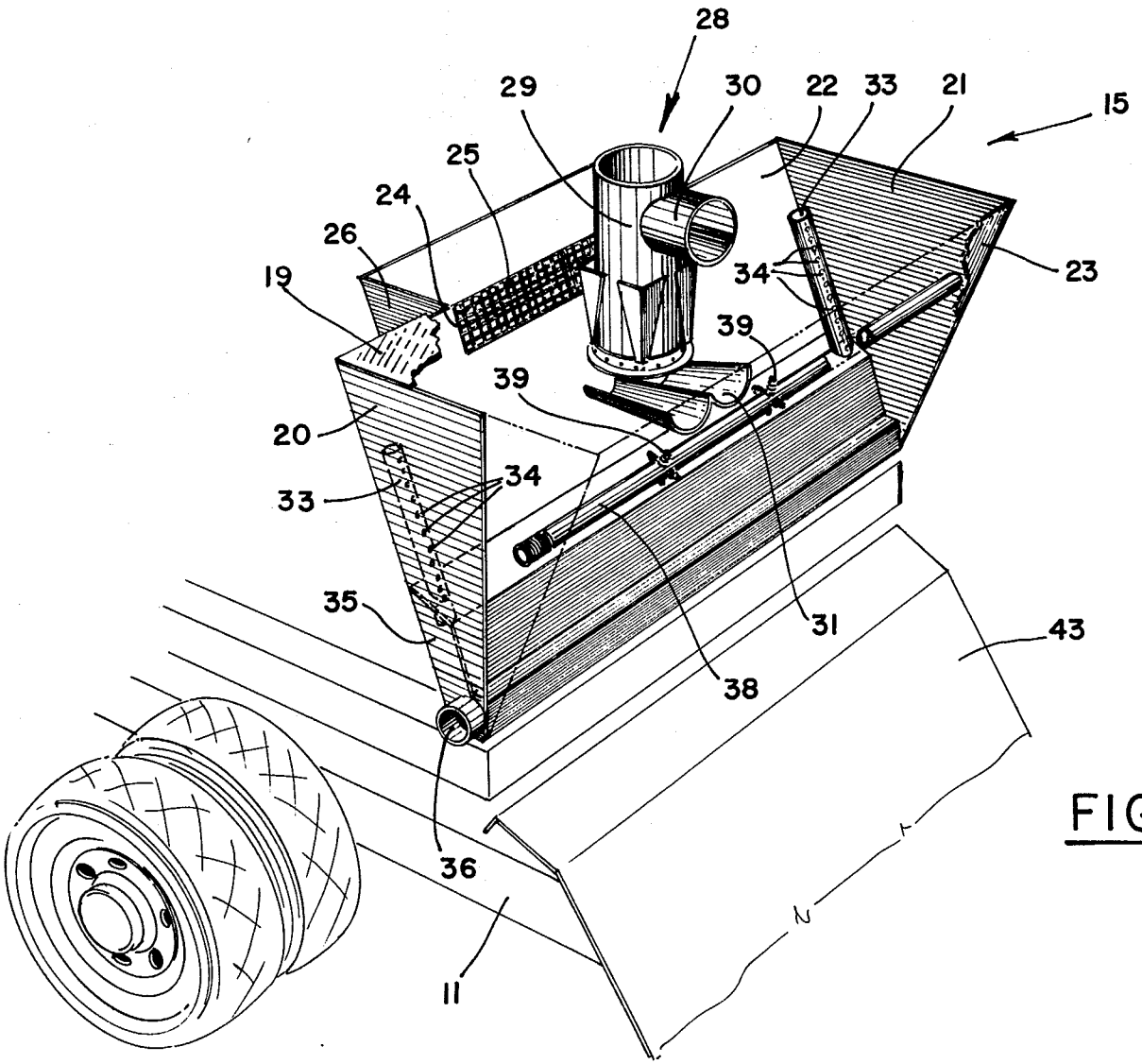
FIG. 2 is a perspective view of the debris collection chamber according to the concept of the present invention.

Debris collection chamber 15 is best shown in FIG. 2 as taking on an inverted prism-like configuration having a horizontally oriented top wall 19, two generally parallel side walls 20, 21, and two end walls, 22, 23, converging from the ends of top wall 19 to abut at the bottom extent of chamber 15, that is, at the apex of the inverted prism. In actuality, as will hereinafter be described in detail, end wall 23 is a movable door utilized to discharge debris from chamber 15.

Chamber 15 communicates with fan 12 through a duct 24 at the top of end wall 22. A screen 25 can be provided over duct 24 to assure that debris will not enter an isolation chamber 26 located between fan 12 and chamber 15. Chamber 15 also communicates with vacuum conduit boom assembly 18 by means of an elbow inlet tube 28 having a downwardly directed branch 29 extending through top wall 19 of chamber 15 to a point lower than duct 24. Tube 28 also includes a second branch 30 extending generally at a right angle to branch 29 above chamber 15.

As will hereinafter be described in more detail, as engine 13 operates fan 12, a vacuum is created in chamber 15 and debris laden air is drawn into chamber 15 through elbow inlet tube 28. A splitter deflector plate 31 is attached to wall 22 and additionally supported by brace 32 (FIG. 1) extending from top wall 19 to be positioned immediately below branch 29 of inlet tube 28. Splitter deflector plate 31 not only breaks the fall of larger heavy objects, such as bricks, rocks or the like, which may be picked up, but it also serves to divert the debris in two directions and evenly spread the same in the chamber. As the air enters chamber 15, a rapid decrease in velocity is created which permits additional debris to drop into the chamber. Material still entrained in the air being drawn by the vacuum created by fan 12 will also often contact the converging end walls 22 and 23 thereby losing energy and dropping out of the air flow. The air is then drawn upward through screen 25 and into chamber 26 and finally exhausted through outlet duct 37 above fan 12.

Because water is often drawn into chamber 15 with the debris, particularly when the sewer is being flushed simultaneously with water from the hose on hose reel 16, chamber 15 can be provided with two drain members 33 shown as being mounted in the corners between walls 20 and 22 and walls 21 and 22, respectively. Each drain member 33 is preferably in the form of hollow pipe having apertures 34 therein. The bottom of each drain member 33 communicates with a water collection chamber 35 formed near the bottom of chamber 15 and against wall 22. Thus, as water might build up in chamber 15 to the level of apertures 34 in drain members 33, it will drain into chamber 35. A drain pipe 36 is mounted at the bottom of chamber 35 so that periodically the water collected in chamber 35 may be removed.

Chamber 15 is also provided with a cleaning manifold 38 which is in the form of a pipe running between side walls 20 and 21. Manifold 38 is provided with a plurality of cleaning nozzles 39 and is adapted to be attached to an accessory gun line hose (not shown) or could be adapted to connect to the hose on hose reel 16 so that the inside of chamber 15 may be cleaned by the high pressure spray emitted from nozzles 39. In addition, it is possible to utilize manifold 38 to aid in the separation of the debris from the air. In situations where very dry dusty debris is being picked up, manifold 38 can be run at a lower pressure to lightly moisten the debris to aid in the separation thereof from the air.

As described hereinabove and shown in FIG. 1, end wall 23 is a door used to empty debris from chamber 15, it being hinged, as at 40, so that it can be swung open. It is maintained tightly closed by a locking device 41 which is shown as a conventional over-the-center lock but which could be any device capable of holding end wall 23 against end wall 22. In order to open end wall or door 23, locking device 41 is merely released and cylinder 42 activated to swing wall 23 to a generally vertical position. Debris will then readily drop out of chamber 15 being aided by the slope of wall 22. A rear bumper guard 43 protects the structure of the vehicle from heavy debris and otherwise guides the debris to the dumping site.

End wall or door 23 also carries hose reel 16. A support bracket 44 extends from wall 23 and carries bearing housing 45 into which is journalled the axle 46 of hose reel 16. A support angle 48 mounted on wall 23 carries bearing housing 49 for the other end of axle 46. End wall 23 is cut out, as at 50, so that the hose reel may be positioned vertically while chamber 15 is closed. Wall 23 also carries a hydraulic motor (not shown) operated by control lever 51 to rotate reel 16 on axle 46 to wind or unwind the hose. A brace 52 extends from bracket 44 to wall 23 to carry a conventional hose guide assembly 53 which includes a support 54 and conventional hose guide 55. As hose is being payed out into the sewer, it is threaded through guide 55 for control by the operator.

Still referring to FIG. 1, vaccum conduit boom assembly 18 will now be described in detail. Assembly 18 inlcudes an adjustable vacuum conduit 56 constructed of a plurality of sections—some solid tubular sections 58 and other flexible hose-like sections 59. A supply of these sections may be readily carried by the vehicle and may be conventionally assembled in any configuration to meet the requirements of the job being performed. The first hose section 59 is attached to branch 30 of elbow 28, as by clamp 60, and to the first tubular section 58, as by clamp 61. Two arms 62 (only one shown) extend from clamp 60 to clamp 61 and are pin connected, as at 63, to two trunnion plates 64 (only one shown). The tops of trunnion plates 64 are pin connected, as at 65, to a large mechanical screw 66 which is gear driven by motor 68 mounted on the top of elbow 28. As shown in FIG. 1, screw 66 is in its extended position but may be retracted to pivot trunnion plates 64 on the axis of pin 63 to manipulate vacuum conduit 56. In operation, usually a certain depth of debris will exist on the floor of the sewer. The end of vacuum conduit 56 is first positioned on the top of the debris. At this time screw 66 is retracted. Then as debris is being picked up, the screw may be extended to keep vacuum conduit 56 in communication with the debris.

A flange 69 on branch 29 of elbow 28 rests on the top of top wall 19 thereby rendering elbow 28 freely rotatable thereon to permit operation of the vacuum conduit not only off the rear of the vehicle but also off the sides thereof should that be desirable, thereby giving essentially a 180° range of operation.

Figure 3:
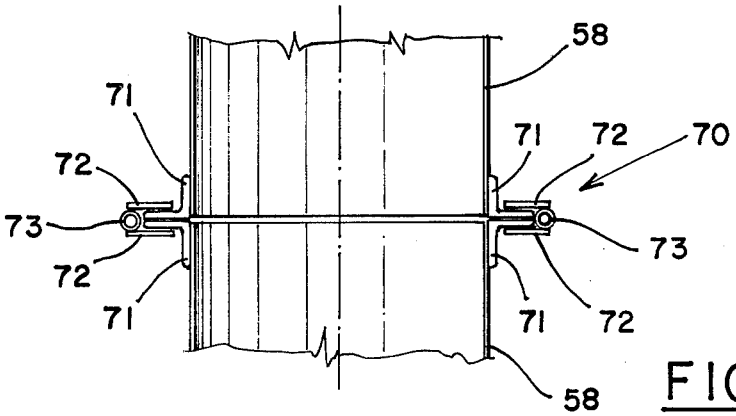
FIG. 3 is a sectional view taken substantially along line 3—3 of FIG. 2.

Between two sections 58 of vacuum conduit 56 there may be mounted a swivel connection indicted generally by the numeral 70 and shown in detail in FIG. 3. An annular angle flange 71 is affixed at the adjoining ends of each section 58 in swivel connection 70 so that they rest on each other. Two split clamp rings each consisting of two semiannular plates 72 spaced by semiannular tubing 73 are placed around angle flange 71 and attached together in a conventional manner. Thus, the two sections 58 so connected may be rotated with respect to each other. Such rotation may be desirable in order to work the lower part of the conduit into a sewer or catch basin, or various portions thereof to totally clean the same. To promote and control such rotation, a handle 74 of steering wheel-like configuration may be affixed to a section 58 below swivel connection 70 and conveniently above the ground for use by the operator.

Figure 4:
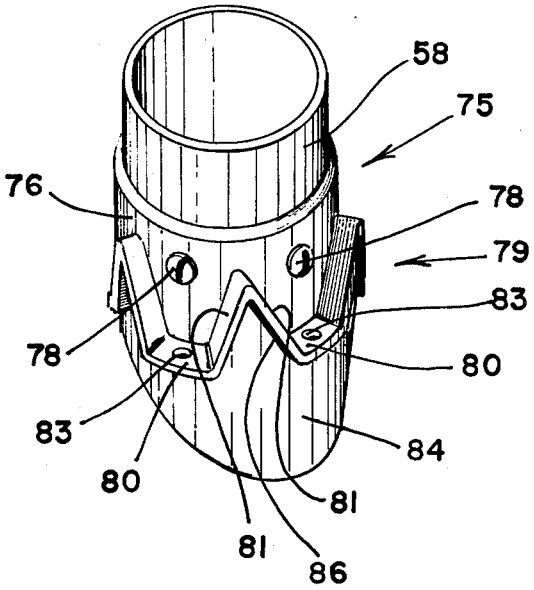
FIG. 4 is a perspective view of an adapter which can be placed on the end of the vacuum conduit when working in rounded sewers or catch basins.
Figure 5:
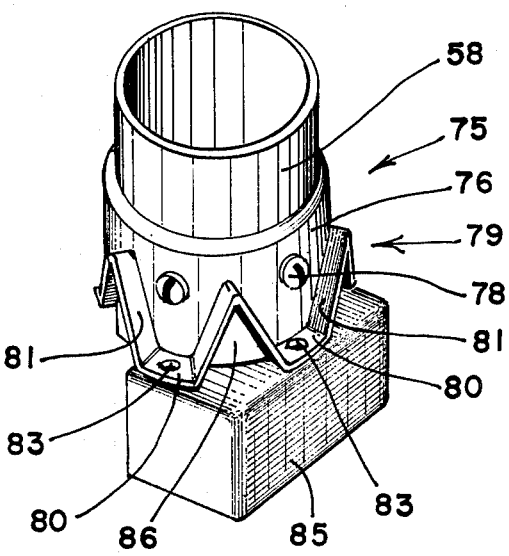
FIG. 5 is a perspective view of an alternative adapter which can be placed on the end of the vacuum conduit when working in corners of sewers or catch basins.

As shown in FIG. 1, the suction end of vacuum conduit 56 is provided with a foot section, indicated generally by the numeral 75, and including a cylindrical sleeve 76 which is adapted to fit around the bottom or last tubular section 58 being held thereto by suitable fastening means (not shown) received through apertures 78 (FIGS. 4 and 5). Foot section 75 is cast with a sawtooth-like embossment, indicated generally by the numeral 79, having alternate flat bottom portions 80 and angular portions 81 in the form of a triangle. The cylindrical sleeve only extends between each angular portion 81 above each bottom portion 80 thus providing triangular openings 82 to the inside of vacuum conduit 56. If foot section 75 is used as shown in FIG. 1, conduit 56 may be lowered into the sewer or catch basin and if bottom portions 80 should rest directly against the floor of the sewer or catch basin, debris will still be picked up through openings 82 and the vacuum will not be lost.

In order to efficiently work at the edges (either rounded or cornered) of sewers or catch basins, foot section 75 may be provided with an adapter section, two typical types being shown in FIGS. 4 and 5. Each bottom portion 80 of foot section 75 is provided with an aperture 83 which receives a fastening means (not shown) to carry the adapter 84 of partial circular configuration (FIG. 4) or adapter 85 of partial rectangular configuration (FIG. 5). In each instance the adapters 84, 85 include a cylindrical skirt 86 which closes openings 82 in foot section 75. Thus, if it were required to dig out a round (FIG. 4) or square (FIG. 5) corner of a sewer, the particular adapter would be selected and by manipulation of handle 74, the edge of the sewer will be efficiently cleaned. Because by using either adapter 84 or 85 the foot section 75 will never bottom out, openings 82 are not necessary to assure air flow and thus skirts 86 are used to close off the openings and actually prevent air from moving above the debris which could result in inefficient cleaning.

In overall operation of the unit 10, the vehicle would be driven to the sewer site to be cleaned and positioned for easy access to the sewer. As previously described, because of the maneuverability of elbow 28 of vacuum conduit assembly 18, precise location of the vehicle with respect to the sewer is not critical. Usually the sewer is first flushed by pumping water, driven by engine 13, through the hose lowered into the sewer. Then the debris which is flushed to a place of access in the sewer, such as a manhole, is picked up by conduit 56 with engine 13 driving fan 12. In certain situations it may be desirable to flush and vacuum at the same time which, through a conventional clutch arrangement on engine 13, is possible; that is, either or both the pump and fan can be operated. As the debris enters chamber 15 through branch 29 of tube 28, the rapid decrease in velocity of the air, due to its entrance into a larger chamber, permits at least some of the debris to drop out of the air and into the chamber. The debris which might remain, usually the lighter material such as sand and the like, may still be entrained in the air. This debris-laden air, being drawn by the vacuum fan 12, will begin to circulate in chamber 15 back up toward duct 24, which, as was previously described, is located above the entry point of branch 29 of tube 28. As the air circulates, it will thus contact at least end wall 23 causing the debris remaining therein to lose energy and drop into the chamber. The air exits through duct 24. As the debris is collected in hopper 20, water build-up may be discharged to chamber 35 which can be subsequently emptied after each run. Again by means of the clutch arrangement, if particularly dry debris is being collected, separation thereof from the air may be enhanced by pumping water through cleaning manifold 38 while at the same time driving the fan to collect the debris.

Figure 6:
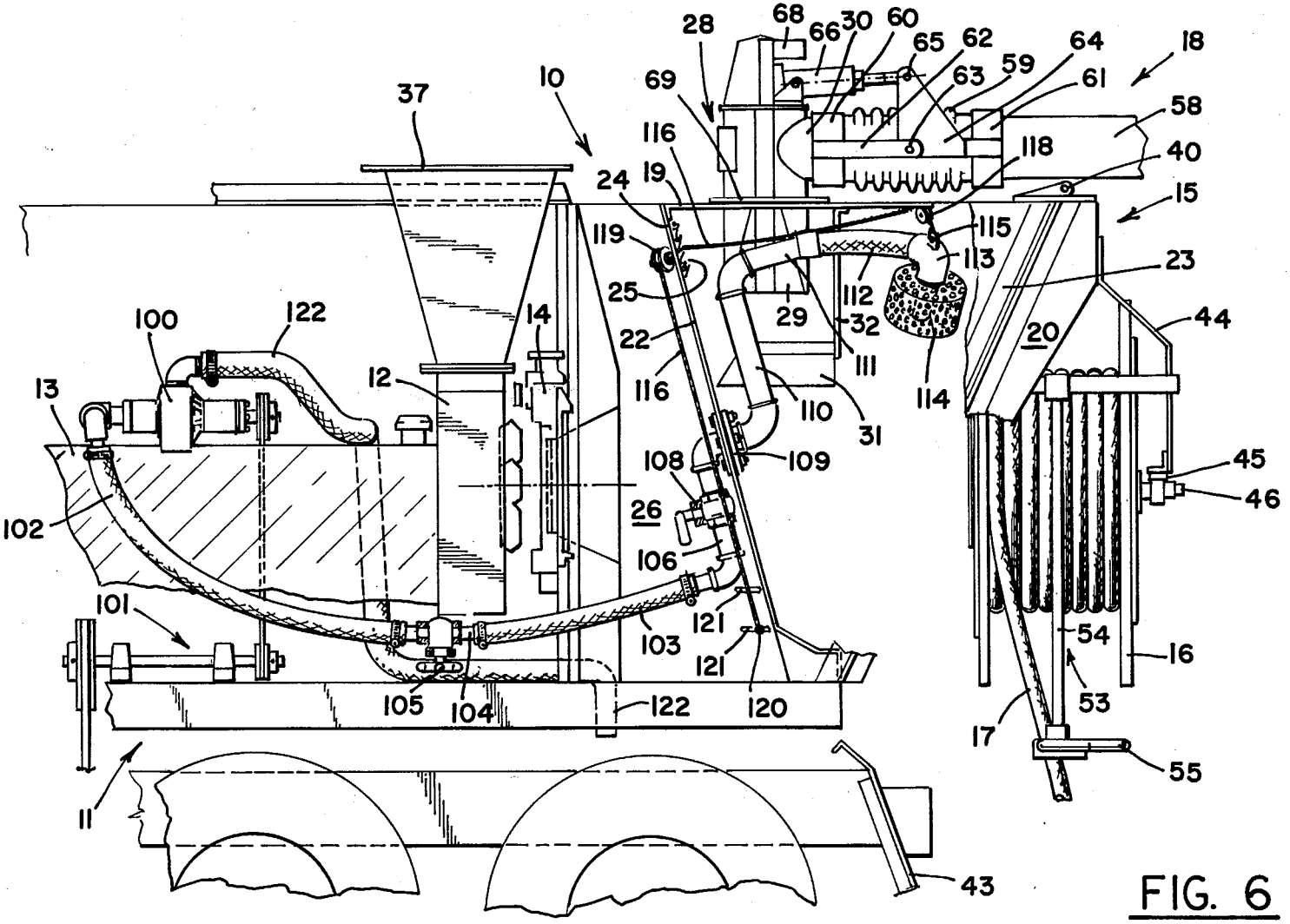
FIG. 6 is a somewhat schematic, partially broken away, elevational view of an alternate embodiment of the present invention.

An alternate embodiment of the present invention is shown in FIG. 6. The majority of the components shown in FIG. 6 are identical to those shown in FIG. 1, have been numbered the same, and therefore need not be described again. In addition, some of the elements of FIG. 1 have been omitted from or are more schematically shown in FIG. 6, it being understood that these elements are compatible with the embodiment of FIG. 6. In this embodiment a different type of chamber drainage system is shown. In situations where a great deal of water is taken into chamber 15, water collection chamber 15 may fill quite rapidly necessitating frequent discharge. Also, under certain conditions debris could clog apertures 34 of drain members 33 thereby impeding the efficient removal of water. Thus, drain member 33 and water collection chamber 35 are not shown in this embodiment but rather replaced by a drainage system which can selectively, and continually if desired, remove water from the chamber to a location remote from the mobile apparatus.

The system is somewhat schematically shown in FIG. 6 as including a pump 100 selectively driven through an operator controlled clutch arrangement, indicated generally by the numeral 101, by engine 13. A hose 102 is connected to the suction side of pump 100 with a second hose 103 being connected thereto by a coupling 104. Coupling 104 is provided with a petcock 105 to drain water from hoses 102 and 103 to prevent freezing in the winter.

Hose 103 is connected to piping 106 which has a ball valve 108 therein for closing the line when there is no water in the debris. The piping extends through the end wall 22 of chamber 15, as at 109, and additional piping 110 and 111 extends upwardly along end wall 22 and across along top wall 19, respectively, within chamber 15. A flexible hose 112 is connected to pipe 111 and has an elbow joint 113 at the end thereof which carries a suction strainer assembly 114.

Elbow 113 is provided with an eyelet 115 to hold the end of a cable 116. Cable 116 is threaded through one or more eyelets 118 attached to top wall 19 and extends through end wall 22, around a pulley 119 and down along the outside of end wall 22. A T-handle 120 is provided at the end of cable 116 to engage one of a plurality of stop bars 121 (two shown) extending from end wall 22. Cable 116 is used to raise and lower strainer 114 to the appropriate height dependent on the depth of the water in chamber 15. The operator, through a sight glass in end wall 23 of chamber 15, can observe the depth of the water in the chamber and adjust the height of the strainer by locking the cable at the appropriate stop bar 121. Thus, in situations involving heavy water content, such as when hose 17 is flushing the sewer at the same time conduit 56 is picking up debris, pump 100 may be continually running with strainer 114 at the appropriate height, to draw water through a pump discharge hose 122 to some remote location such as a nearby storm drain or the like. In dry debris situations, strainer 114 may be pulled up to the fully raised position, somewhat higher than that shown in FIG. 6 and the pump 100 not utilized at all.

It should thus be evident that a combined sewer cleaning and vacuum unit constructed according to the concept of the invention described herein substantially improves the sewer cleaning art and otherwise accomplishes the objects of the present invention.

I claim:

1. Mobile apparatus for cleaning sewers and the like comprising a vehicular body member; a chamber for collecting debris mounted on said vehicular body member; conduit means communicating with said chamber and adapted to be lowered into the sewer; a hose adapted to be lowered into the sewer to carry water to flush the same; a hose reel carried by said chamber and carrying said hose; vacuum means communicating with said chamber and drawing air through said conduit means and said chamber whereby debris and water are picked up from the sewer, drawn through said conduit means and deposited in said chamber; suction strainer means selectively positionable within said chamber; pump means selectively operable to remove the water from said chamber and transfer the same to a location remote from the apparatus; and means to connect said suction strainer means to said pump means.

2. Apparatus according to claim 1 further comprising means to position said suction strainer means at varying heights within said chamber.

3. Apparatus according to claim 2 wherein said means to position said suction strainer means includes cable means connected to said suction strainer means, and means to hold said cable means at selected positions.

4. Apparatus according to claim 1 wherein said chamber includes a top wall, two generally parallel side walls, and two end walls converging from said top wall, said vacuum means communicating with said chamber through one said end wall near the top thereof and said conduit means communicating with said chamber through said top wall but at a point below the communication of said vacuum means with said chamber.

5. Apparatus according to claim 4 further comprising means to swing one said end wall away from the other said end wall to discharge debris from said chamber.

6. Apparatus according to claim 5 wherein said hose reel is carried by said one said end wall.

7. Mobile apparatus for cleaning sewers and the like comprising a vehicular body member; a chamber for collecting debris mounted on said vehicular body member, said chamber having a top wall, two generally parallel side walls, and two end walls converging from said top wall; conduit means communicating with said chamber through the top thereof and adapted to be lowered into the sewer; vacuum means communicating with said chamber through one said end wall near the top thereof at a point above the communication of said conduit means with said chamber to draw air, liquid and debris through said conduit means and into said chamber; pump means selectively operable to draw liquid out of said chamber and transfer the same to a location remote from the apparatus; suction strainer means selectively positionable within said chamber; and means to connect said suction strainer means to said pump means.

8. Apparatus according to claim 7 further comprising means to swing one said end wall away from the other said end wall to discharge debris from the chamber.

9. Apparatus according to claim 8 further comprising means carried by said one said end wall to permit flushing of the sewer with liquid.

10. Apparatus according to claim 7 further comprising deflector plate means below the point of communication of said vacuum means with said chamber to evenly spread the debris within said chamber.

11. Apparatus according to claim 7 further comprising means to position said suction strainer means at varying heights within said chamber.

12. Apparatus according to claim 7 further comprising cleaning manifold means in said chamber adapted to receive water under pressure and including nozzle means to emit water to clean the inside of said chamber.

13. Apparatus according to claim 7 wherein said conduit means is rotatable with respect to said top wall of said chamber.

14. Apparatus according to claim 13 further comprising means to manipulate said conduit means to maintain the same in communication with debris in the sewer.

15. Apparatus according to claim 7 wherein said conduit means includes a plurality of conduit sections and further comprising swivel connection means between two of said conduit sections permitting said two of said conduit sections to be rotatable with respect to each other.

16. Apparatus according to claim 15 further comprising handle means affixed to a said section between said swivel connection means and the end of said conduit means adapted to be lowered into the sewer to control said conduit means.

17. Apparatus according to claim 7 wherein said conduit means includes foot means on the end thereof received in the sewer and having flat bottom portions adapted to rest on the floor of the sewer and a plurality of openings above said flat bottom portion to permit air to be drawn through said conduit means by said vacuum means.

18. Apparatus according to claim 17 further comprising adapter means of a selected configuration attached to said foot means and extending below the flat bottom surface thereof for manipulation in sewers some portion of which having a complementary configuration.

19. Apparatus according to claim 18 wherein said adapter means includes means to close the openings in said foot means.

* * * * *